US011339652B1

(12) United States Patent
Alshammari et al.

(10) Patent No.: US 11,339,652 B1
(45) Date of Patent: May 24, 2022

(54) SAMPLING FORMATION FLUID IN OIL AND GAS APPLICATIONS

(71) Applicant: Saudi Arabian Oil Company, Dhahran (SA)

(72) Inventors: Nawaf Saud Alshammari, Abqaiq (SA); Auda Khalid AlDulaijan, Abqaiq (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/089,126

(22) Filed: Nov. 4, 2020

(51) Int. Cl.
*E21B 49/08* (2006.01)

(52) U.S. Cl.
CPC ..... *E21B 49/083* (2013.01)

(58) Field of Classification Search
CPC ..... E21B 47/01; E21B 49/081
See application file for complete search history.

(56) References Cited

U.S. PATENT DOCUMENTS 2,137,296 A * 11/1938 Macready ..... E21B 49/081 166/70
5,540,280 A 7/1996 Schultz et al.
5,799,733 A 9/1998 Ringgenberg et al.
6,236,620 B1 5/2001 Schultz et al.
7,093,674 B2 8/2006 Paluch et al.
2004/0020691 A1* 2/2004 Krueger ..... E21B 47/022 175/27
2005/0178543 A1* 8/2005 Giacomino ..... E21B 43/121 166/250.01
2005/0284659 A1* 12/2005 Hall ..... H04L 67/02 175/27
2006/0225880 A1* 10/2006 Radzinski ..... E21B 47/017 166/250.01
2007/0151767 A1 7/2007 Downton
2011/0198076 A1* 8/2011 Villreal ..... E21B 49/005 166/250.01
2012/0138292 A1* 6/2012 Miller ..... E21B 49/081 166/264
2013/0019672 A1* 1/2013 Hemsing ..... E21B 47/06 73/152.51
2015/0039230 A1* 2/2015 Proett ..... E21B 17/206 702/6
2015/0176344 A1* 6/2015 McLoughlin ..... E21B 17/1078 175/24
2016/0208596 A1* 7/2016 Ash ..... E21B 47/12

* cited by examiner

*Primary Examiner* — Shane Bomar
(74) *Attorney, Agent, or Firm* — Fish & Richardson P.C.

(57) ABSTRACT

A method of sampling a fluid from a rock formation includes deploying a downhole sampling tool to a target zone within a wellbore of the rock formation, with the downhole sampling tool being coupled to a downhole end of a drill pipe. The method further includes rotating the drill pipe within the wellbore while maintaining a body of the downhole sampling tool in a stationary angular position and while collecting samples of the fluid from the rock formation at the downhole sampling tool.

14 Claims, 2 Drawing Sheets

SAMPLING FORMATION FLUID IN OIL AND GAS APPLICATIONS

TECHNICAL FIELD

This disclosure relates to methods of sampling formation fluid and related systems and downhole tools.

BACKGROUND

Collecting formation fluid samples from a rock formation with a sampling tool at a downhole end a drill string requires the sampling tool and therefore, the drill string, to be stationary for a prolonged period of time. For example, depending on a permeability of the rock formation, the drill string may need to be stationary over four hours. While the stationary positioning is necessary for operation of the sampling tool, such stationary positioning also facilitates undesirable, differential sticking along surface areas of contact between the drill string and the rock formation. In addition to preventing a drill string from being able to rotate or reciprocate within a wellbore, differential sticking may also result in several other negative consequences to wellbore operations, including additional costs associated with freeing the drill string from a stuck position and mud particle accumulation around the drill string within the wellbore.

SUMMARY

This disclosure relates to methods of sampling formation fluid and sampling systems and tools for carrying out such sampling. For example, a downhole sampling tool is designed to sample formation fluid from a rock formation within a wellbore while maintaining a drill pipe that is coupled to an uphole end of the downhole sampling tool in a rotational state (for example, in a rotary mode). The downhole sampling tool includes a tool body that is equipped with a battery, a rotational device (for example, a swivel) at its uphole end, and an electronics module for receiving communication from a mud circulation system at the surface of the wellbore. The rotational device is attachable to the drill pipe and allows the drill pipe to rotate even while the tool body remains stationary during a sampling operation. Rotation of the drill pipe minimizes a time period during which any given circumferential point on the drill pipe is in contact with the rock formation and thus results in an overall minimal surface contact area between the drill pipe and the rock formation. The minimal surface contact area prevents or reduces the likelihood that the drill pipe will become stuck against a wall of the rock formation in a phenomenon known as differential sticking.

In one aspect, a method of sampling a fluid from a rock formation includes deploying a downhole sampling tool to a target zone within a wellbore of the rock formation, with the downhole sampling tool being coupled to a downhole end of a drill pipe. The method further includes rotating the drill pipe within the wellbore while maintaining a body of the downhole sampling tool in a stationary angular position and while collecting samples of the fluid from the rock formation at the downhole sampling tool.

Embodiments may provide one or more of the following features.

In some embodiments, the method further includes applying a torque to an uphole end of the drill pipe with a rotary system located at a surface of the wellbore.

In some embodiments, the method further includes allowing rotation of the drill pipe at the downhole end with respect to the body of the downhole sampling tool using a rotational device of the downhole sampling tool that is secured to the body.

In some embodiments, the rotational device includes a swivel.

In some embodiments, the method further includes rotating the drill pipe at an angular speed within a range of about 5 rpm to about 60 rpm.

In some embodiments, the method further includes powering the downhole sampling tool with a battery of the downhole sampling tool.

In some embodiments, the battery is replaceable on the downhole sampling tool.

In some embodiments, the method further includes receiving an operational signal at an electronics module of the downhole sampling tool from a component located at a surface of the rock formation.

In some embodiments, the operational signal includes a series of mud pulses, and the component includes a portion of a mud circulation system.

In some embodiments, the method further includes decoding the operational signal to activate the downhole sampling tool.

In some embodiments, the method further includes decoding the operational signal to determine a frequency at which the samples of the fluid are to be collected from the rock formation.

In some embodiments, the method further includes deploying the downhole sampling tool to a test position within the wellbore before deploying the downhole sampling tool to the target zone and testing a functionality of the downhole sampling tool at the test position.

In another aspect, a downhole sampling tool includes a tool body at which fluid samples are collected, a rotational device carried on the tool body and configured to allow rotation of a pipe connected to an uphole end of the tool body with respect to the tool body, and an electronics module configured to receive signals for controlling operation of the downhole sampling tool to collect the fluid samples.

Embodiments may provide one or more of the following features.

In some embodiments, the rotational device includes a swivel.

In some embodiments, the downhole sampling tool further includes a battery carried on the tool body for powering the sampling tool.

In some embodiments, the battery is replaceable on the downhole sampling tool.

In another aspect, a fluid sampling system includes a drill pipe disposed within a wellbore of a rock formation, a rotary system disposed at a surface of the rock formation and coupled to an uphole end of the drill pipe for rotating the drill pipe, a mud circulation system disposed at a surface of the rock formation, and a downhole sampling tool coupled to a downhole end of the drill pipe. The downhole sampling tool includes a tool body at which fluid samples are collected, a rotational device carried on the tool body and configured to allow rotation of the drill pipe with respect to the tool body, and an electronics module configured to receive signals from the mud circulation system for controlling operation of the downhole sampling tool to collect the fluid samples.

Embodiments may provide one or more of the following features.

In some embodiments, the rotational device includes a swivel.

In some embodiments, the downhole sampling tool further includes a battery carried on the tool body for powering the sampling tool.

In some embodiments, the battery is replaceable on the downhole sampling tool.

The details of one or more embodiments are set forth in the accompanying drawings and description. Other features, aspects, and advantages of the embodiments will become apparent from the description, drawings, and claims.

DETAILED DESCRIPTION

Figure 1:
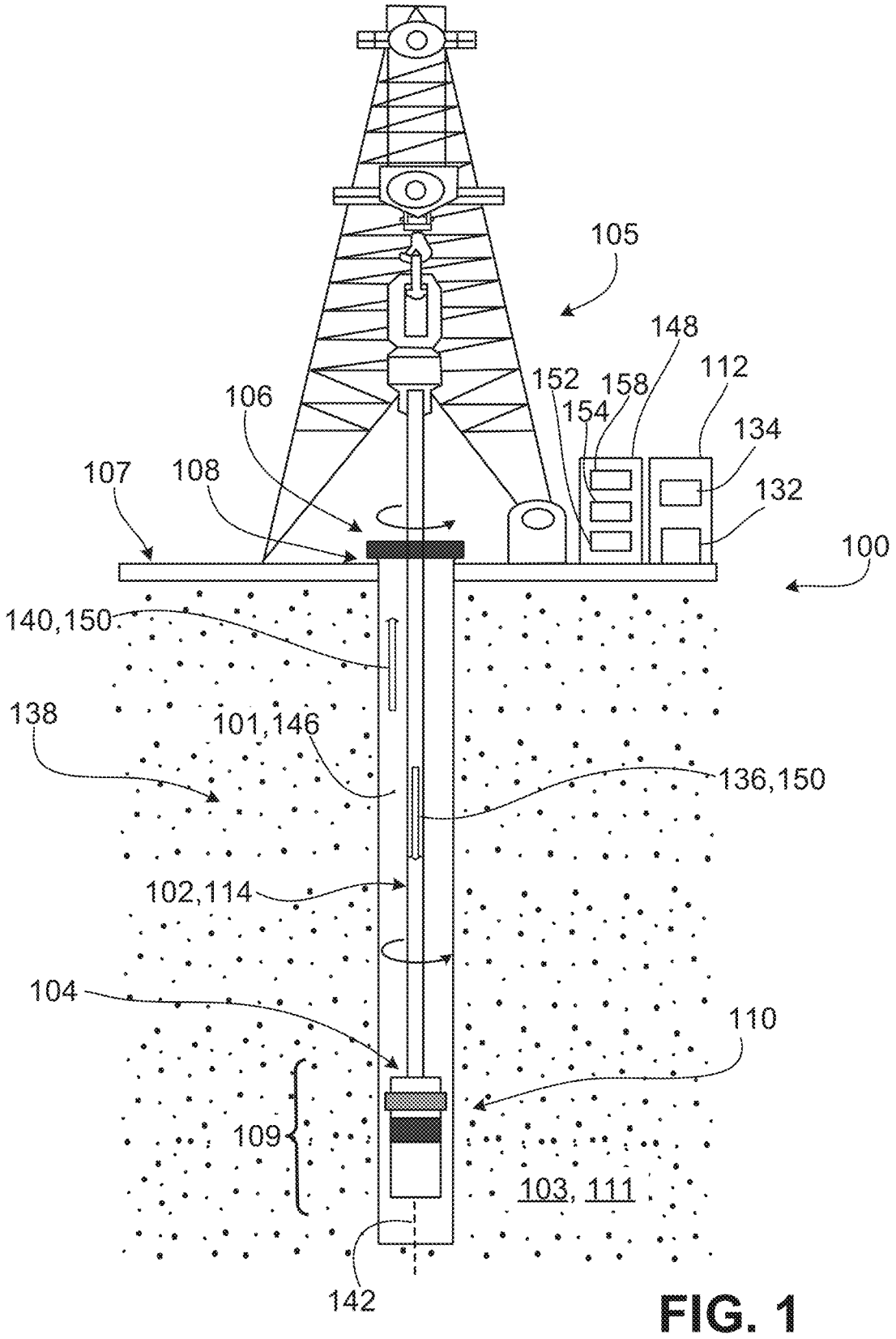
FIG. 1 is a side view of a sampling system installed at a wellbore within a rock formation.

FIG. 1 illustrates an example fluid sampling system 100 that is designed to sample formation fluid 111 at a wellbore 101 within a rock formation 103. The fluid sampling system 100 includes a drill pipe 102 to be deployed within the wellbore 101 during a drilling and workover operation at a rig 105, a downhole sampling tool 110 that is coupled to a downhole end 104 of the drill pipe 102 for sampling the formation fluid 111 from the rock formation 103, and a rotary system 106 (for example, a top drive system) that is coupled to an uphole end 108 of the drill pipe 102 for imparting rotation to the drill pipe 102 at a surface 107 of the wellbore 101.

The fluid sampling system 100 also includes a mud circulation system 112 that is located at the surface 107 for circulating mud 150 within the wellbore 101 to communicate with the downhole sampling tool 110. For example, the mud circulation system 112 may include a pump 132 for pumping mud through the drill pipe 102 in a downhole direction 136 in a pulsative manner and a control module 134 for controlling a variable flow rate (for example, a frequency) at which the mud 150 is pumped. Mud pulses (for example, downlinks) sent by the mud circulation system 112 pass through the downhole sampling tool 110 and, while passing through, can be decoded by the downhole sampling tool 110 into operational commands.

After passing through the downhole sampling tool 100, the mud 150 circulates in an uphole direction 140 back to the surface 107 through an annular region 146 defined between the drill pipe 102 and the rock formation 103. Accordingly, the fluid sampling system 100 also includes a mud analyzer 148 located at the surface 107 for collecting and analyzing the circulated mud 150. The mud analyzer 148 is equipped with a fluid collection chamber 152 and a pressure transducer 154 and control logic 158, among other components, for performing these respective functions.

The downhole sampling tool 110 is operable to collect volumetric samples of formation fluid 111 from the rock formation 103, analyze the samples to generate data that characterizes the formation fluid 111 and the rock formation 103, and circulate mud pulses that encode the data to the surface 107. Advantageously, the downhole sampling tool 110 is designed to remain stationary at a target zone 109 during a sampling operation while simultaneously rotating the drill pipe 102 (for example, spinning the drill pipe 102 about its axis 142) within the wellbore 101. Rotation of the drill pipe 102 minimizes a time period during which any given point on an exterior wall surface 114 of the drill pipe 102 is in contact with the rock formation 103 and thus prevents or reduces the likelihood that the drill pipe 102 will succumb to differential sticking against the rock formation 103 within the wellbore 101.

Figure 2:
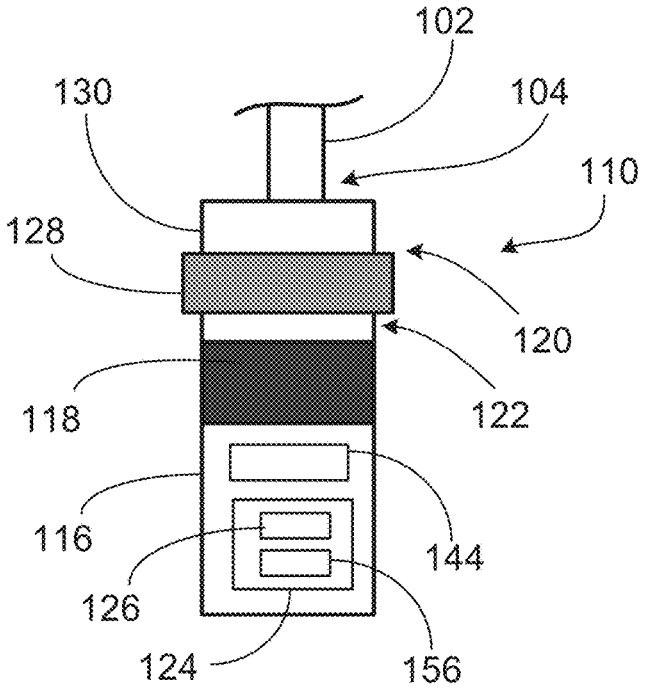
FIG. 2 is an enlarged side view of a downhole sampling tool of the sampling system of FIG. 1.

Referring to FIG. 2, the downhole sampling tool 110 includes a tool body 116 that is equipped with components 144 designed to collect the samples of formation fluid 111. Such components 144 may include a fluid analyzer for characterizing the formation fluid 111 with respect to several fluid parameters, sensors for determining characteristics of the rock formation 103 (for example, formation pressure and mobility), a pump for pumping formation fluid 111 out of the rock formation 103, and fluid chambers (for example, fluid bottles) for collecting and storing formation fluid 111. Fluid parameters that may be determined by the fluid analyzer include density, gas/oil ratio, viscosity, temperature, and hydrocarbon composition, among others.

The tool body 116 is also equipped with a battery 118 for powering the downhole sampling tool 110, a rotational device 120 at an uphole end 122 that allows the drill pipe 102 to rotate due to torque applied to the uphole end 108 of the drill pipe 102 by the rotary system 106, and an electronics module 124 including control logic 126 that receives communications from the mud circulation system 112 at the surface 107. The rotational device 120 is embodied as a swivel including a stationary support base 128 that is rigidly connected to the tool body 116 and a rotary component 130 that is rotatable with respect to the support base 128 and rigidly connected to the downhole end 104 of the drill pipe 102. The rotational device 120 thus allows the tool body 116 of the downhole sampling tool 110 to remain in a fixed rotational position (for example, a fixed angular position) while the drill pipe 102 rotates within the wellbore 101. The rotary system 106 and the rotational device 120 together ensure that the drill pipe 102 rotates in a stable, secure manner along an entire length of the drill pipe 102.

The electronics module 124 can determine characteristics (for example, amplitude, frequency, and pressure of mud pulses (for example, pressure pulses) sent from the mud circulation system 112 and decode these characteristics into commands. In this way, the mud pulses serve as signals carrying executable commands. The electronics module 124 can execute those commands to sample the formation fluid according to certain parameters (for example, activation or deactivation of the pump of the downhole sampling tool 110, diversion of formation fluid 111 into the fluid chambers of the downhole sampling tool 110, and a sampling frequency for collecting formation fluid 111. As the formation fluid 111 is sampled, the fluid analyzer and sensors of the downhole sampling tool 110 collect data about the formation fluid 111 and the rock formation 103.

The tool body 116 of the downhole sampling tool 110 is also equipped with a fluid pulsation device 156 (for example, a mud pulser) that is operable to control a flow of mud pumped from the sampling tool 110 in a manner that encodes the data acquired by the fluid analyzer and the sensors. The fluid pulsation device 156 can operate in modes of fully on, partially on (for example, restricted), and off, to generate mud pulses (for example, pressure pulses) that propagate in real time through the annular region 146 and/or through the drill pipe 102 in the uphole direction 140 to the surface 107. The mud pulses are received at the mud analyzer 148 and decoded to reveal the data.

In some examples, the rotary system 106 rotates the drill pipe 102 at an angular speed that falls within a range of about 5 revolutions per minute (rpm) to about 60 rpm. The rotary system 106 may vary the angular speed of the drill pipe 102 based on the characteristics of the mud pulses received from the downhole sampling tool 110. In some examples, the drill pipe 102 is rotated continuously throughout an entire sampling operation. In other examples, the drill pipe 102 is rotated intermittently throughout a sampling operation. In some embodiments, the battery 118 can power the downhole sampling tool 110 for about 24 hours (h) to about 72 h and is replaceable once consumed.

In operation, the downhole sampling tool 110 is installed to the drill pipe 102, and the drill pipe 102 and the downhole sampling tool 110 (for example, together forming a drill string 138) are deployed to a test position at a relatively shallow depth within the wellbore 101 below the surface 107. Mud is then circulated by the mud circulation system 112 as part of a test to confirm that the rotational device 120 of the downhole sampling tool 110 is correctly attached to the drill pipe 102 and that the downhole sampling tool 110 is functioning correctly. Once the test is completed to confirm that the downhole sampling tool 110 is installed and functioning appropriately, the drill string 138 is further run into the wellbore 101 until the downhole sampling tool 110 is positioned at the target zone 109. Mud pulses are circulated at variable flow rates and pressures through the drill pipe 102 and the downhole sampling tool 110 to activate the downhole sampling tool 110, to cause the downhole sampling tool 110 to subsequently carry out the sampling operation, and to then deactivate the downhole sampling tool 110 once the sampling operation has been completed. The drill string 138 may then be moved in the uphole direction 140 or in the downhole direction 136 to position the downhole sampling tool 110 at a next target zone to carry out another the sampling operation or removed from the wellbore 101 altogether to retract the downhole sampling tool 110 for battery replacement, repair, or other maintenance.

By allowing the drill pipe 102 to rotate during fluid sampling, the downhole sampling tool 110 significantly reduces the likelihood that the drill pipe 102 will become stuck in a fixed position within mud accumulated against a wall of the rock formation 103. Accordingly, the downhole sampling tool 110 also avoids remedial costs that would otherwise be associated with freeing the drill pipe 102 from a stuck position within the rock formation 103. In the same manner, the downhole sampling tool 110 also avoids settling of mud particles around the drill pipe 102 (for example, mud sagging) and precipitation of mud along the drill pipe 102 during a sampling operation, as rotation of the drill pipe 102 facilitates homogenization of the mud.

Figure 3:
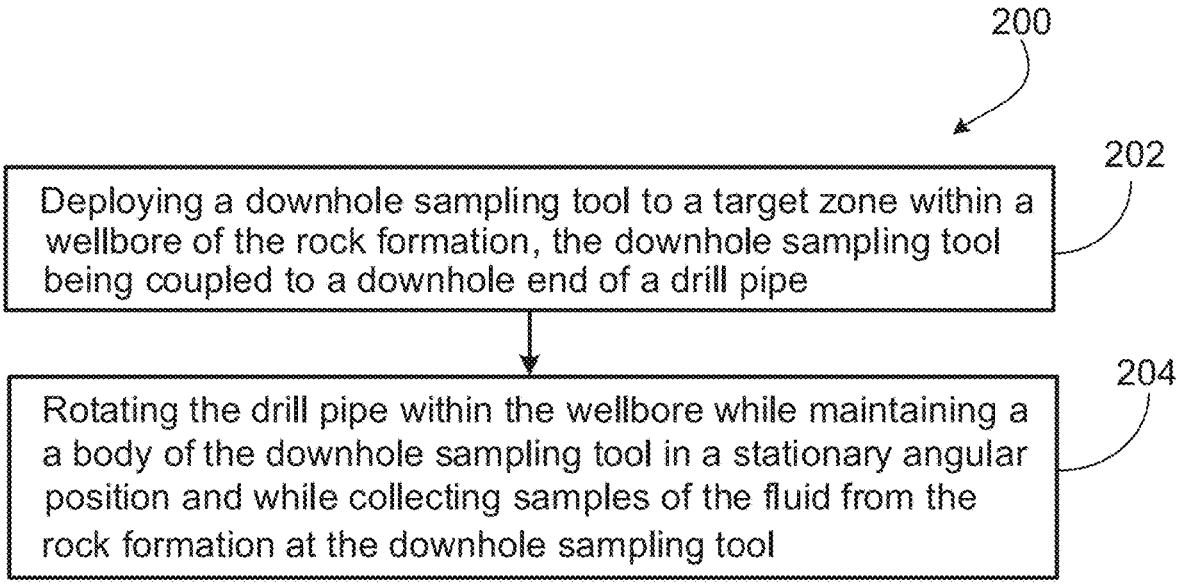
FIG. 3 is a flow chart illustrating an example method of sampling a fluid from a rock formation using the sampling system of FIG. 1 and the downhole sampling tool of FIG. 2.

FIG. 3 is a flow chart illustrating an example method 200 of sampling a fluid (for example, the formation fluid 111) from a rock formation (for example, the rock formation 103). In some embodiments, the method 200 includes a step 202 for deploying a downhole sampling tool (for example, the downhole sampling tool 110) to a target zone (for example, the target zone 109) within a wellbore (for example, the wellbore 101) of the rock formation, the downhole sampling tool being coupled to a downhole end (for example, the downhole end 104) of a drill pipe (for example, the drill pipe 102). In some embodiments, the method 200 further includes a step 204 for rotating the drill pipe within the wellbore while maintaining a body of the downhole sampling tool in a stationary angular position and while collecting samples of the fluid from the rock formation at the downhole sampling tool.

While the fluid sampling system 100 and the downhole sampling tool 110 have been described and illustrated with respect to certain dimensions, sizes, shapes, arrangements, materials, and methods 200, in some embodiments, a fluid sampling system 100 or a downhole sampling tool that is otherwise substantially similar in construction and function to the fluid sampling system 100 or the downhole sampling tool 110 may include one or more different dimensions, sizes, shapes, arrangements, configurations, and materials or may be utilized according to different methods. Accordingly, other embodiments are also within the scope of the following claims.

What is claimed is:

1. A method of sampling a fluid from a rock formation, the method comprising:

deploying a downhole sampling tool to a target zone within a wellbore of the rock formation, wherein the downhole sampling tool is coupled to a downhole end of a drill pipe and comprises:

a tool body, a swivel carried on the tool body and connected directly to the downhole end of the drill pipe, an electronics module carried on the tool body, and a battery carried on the tool body between the swivel and the electronics module for powering the downhole sampling tool; and rotating the drill pipe within the wellbore while maintaining a body of the downhole sampling tool in a stationary angular position and while collecting samples of the fluid from the rock formation at the downhole sampling tool.

2. The method of claim 1, further comprising applying a torque to an uphole end of the drill pipe with a rotary system located at a surface of the wellbore.

3. The method of claim 2, further comprising allowing rotation of the drill pipe at the downhole end with respect to the body of the downhole sampling tool using a rotational device of the downhole sampling tool that is secured to the body.

4. The method of claim 1, further comprising rotating the drill pipe at an angular speed within a range of about 5 rpm to about 60 rpm.

5. The method of claim 1, wherein the battery is replaceable on the downhole sampling tool.

6. The method of claim 1, further comprising receiving an operational signal at an electronics module of the downhole sampling tool from a component located at a surface of the rock formation.

7. The method of claim 6, wherein the operational signal comprises a series of mud pulses, and wherein the component comprises a portion of a mud circulation system.

8. The method of claim 6, further comprising decoding the operational signal to activate the downhole sampling tool.

9. The method of claim 6, further comprising decoding the operational signal to determine a frequency at which the samples of the fluid are to be collected from the rock formation.

10. The method of claim 1, further comprising:

deploying the downhole sampling tool to a test position within the wellbore before deploying the downhole sampling tool to the target zone; and testing a functionality of the downhole sampling tool at the test position.

11. A downhole sampling tool, comprising:

a tool body at which fluid samples are collected;

a swivel carried on the tool body and configured to allow rotation of a pipe connected to an uphole end of the tool body with respect to the tool body, the swivel being connectable directly to the downhole end of the pipe;

an electronics module carried on the tool body and configured to receive signals for controlling operation of the downhole sampling tool to collect the fluid samples; and a battery carried on the tool body between the swivel and the electronics module for powering the downhole sampling tool.

12. The downhole sampling tool of claim 11, wherein the battery is replaceable on the downhole sampling tool.

13. A fluid sampling system, comprising:

a drill pipe disposed within a wellbore of a rock formation;

a rotary system disposed at a surface of the rock formation and coupled to an uphole end of the drill pipe for rotating the drill pipe;

a mud circulation system disposed at a surface of the rock formation; and a downhole sampling tool coupled to a downhole end of the drill pipe, the downhole sampling tool comprising:

a tool body at which fluid samples are collected, a swivel carried on the tool body and configured to allow rotation of the drill pipe with respect to the tool body, the swivel being connected directly to the downhole end of the drill pipe, an electronics module carried on the tool body and configured to receive signals from the mud circulation system for controlling operation of the downhole sampling tool to collect the fluid samples, and a battery carried on the tool body between the swivel and the electronics module for powering the downhole sampling tool.

14. The fluid sampling system of claim 13, wherein the battery is replaceable on the downhole sampling tool.

* * * * *